US009968837B2

(12) United States Patent
Johnston

(10) Patent No.: US 9,968,837 B2
(45) Date of Patent: May 15, 2018

(54) BALL ROTATION INDICATOR AND METHOD

(71) Applicant: Adam W. Johnston, Richmond, TX (US)

(72) Inventor: Adam W. Johnston, Richmond, TX (US)

( * ) Notice: Subject to any disclaimer, the term of this patent is extended or adjusted under 35 U.S.C. 154(b) by 0 days. days.

(21) Appl. No.: 15/373,827

(22) Filed: Dec. 9, 2016

(65) Prior Publication Data

US 2017/0087433 A1 Mar. 30, 2017

Related U.S. Application Data

(63) Continuation of application No. 14/960,240, filed on Dec. 4, 2015, which is a continuation of application No. 14/178,172, filed on Feb. 11, 2014.

(60) Provisional application No. 61/763,191, filed on Feb. 11, 2013.

(51) Int. Cl.

| | |
|---|---|
| ***A63B 69/00*** | (2006.01) |
| ***A63B 43/00*** | (2006.01) |
| ***A63B 24/00*** | (2006.01) |
| ***A63B 71/06*** | (2006.01) |

(52) U.S. Cl.

CPC ..... *A63B 69/0002* (2013.01); *A63B 24/0003* (2013.01); *A63B 43/005* (2013.01); *A63B 71/06* (2013.01); *A63B 2069/0006* (2013.01); *A63B 2071/0694* (2013.01); *A63B 2208/0204* (2013.01); *A63B 2220/35* (2013.01)

(58) Field of Classification Search

CPC ... A63B 43/002; A63B 69/0002; A63B 69/00; A63B 2243/0008; A63B 2242/0004; A63B 2069/0006; A63B 43/007; A63B 43/02; A63B 43/04; A63B 24/0003; A63B 2220/35; A63B 2071/0694

See application file for complete search history.

(56) References Cited

U.S. PATENT DOCUMENTS

| | | | | | |
|---|---|---|---|---|---|
| 1,978,137 | A | * | 10/1934 | Kohn | A63B 59/20 473/614 |
| 2,309,475 | A | * | 1/1943 | Palmieri | A63H 1/12 446/240 |
| 2,925,273 | A | | 4/1958 | Pratt | |
| 3,110,494 | A | | 11/1963 | Morgan | |
| 3,152,803 | A | * | 10/1964 | Sain, Jr. | A63B 69/0002 434/247 |
| D221,962 | S | * | 9/1971 | Vennola | D21/468 |
| 4,199,141 | A | | 4/1980 | Garcia | |
| 4,266,781 | A | * | 5/1981 | Blue | A63F 9/0278 473/575 |
| 4,309,038 | A | * | 1/1982 | Spoon | A63B 65/00 273/146 |
| 4,846,472 | A | | 7/1989 | Terza | |
| 4,930,773 | A | | 6/1990 | Outlaw | |
| D357,500 | S | | 4/1995 | Mutterperl | |

(Continued)

FOREIGN PATENT DOCUMENTS

| | | |
|---|---|---|
| WO | 2008018773 | 2/2008 |

*Primary Examiner* — Steven Wong

(57) ABSTRACT

The present application is directed to an athletic training tool. The athletic training tool includes a ball and an elongated member attached thereto, the elongated member is attached to the ball in a manner effective to maintain the center of gravity of the ball. The elongated member may be visually observable during use of the athletic training tool.

18 Claims, 23 Drawing Sheets

(56) References Cited

U.S. PATENT DOCUMENTS 5,407,193 A 4/1995 McGinley
5,566,935 A 10/1996 Meharg
5,607,152 A 3/1997 Strassburger
5,700,211 A 12/1997 Mackie
5,704,855 A 1/1998 Kellogg, Jr.
5,830,091 A * 11/1998 Romanick ..... A63B 43/00 473/451
6,024,660 A * 2/2000 Romanick ..... A63B 43/00 473/451
6,050,907 A * 4/2000 Long ..... A63B 69/0075 473/451
6,068,580 A * 5/2000 Myers ..... A63B 21/02 446/220
6,151,563 A 11/2000 Marinelli
6,190,292 B1 2/2001 Panes
6,471,606 B1 * 10/2002 Simpson ..... A63B 69/0002 446/23
6,500,078 B1 12/2002 Williams et al.
6,663,519 B2 12/2003 Kuhn et al.
6,945,883 B1 9/2005 Williams et al.
7,175,550 B1 2/2007 Bellah, Jr. et al.
D546,911 S 7/2007 Kirschbaum
7,285,080 B1 10/2007 Chiu
7,297,078 B2 * 11/2007 Libonati ..... A63B 15/005 473/422
7,458,945 B2 12/2008 Zemont
7,488,265 B2 2/2009 Miller et al.
D619,663 S 7/2010 Quinn
D672,415 S * 12/2012 Garcia ..... D21/707
8,439,774 B2 5/2013 Massey
8,608,600 B2 12/2013 Naum
8,771,106 B1 * 7/2014 Boulanger ..... A63B 43/007 473/422
2004/0220001 A1 * 11/2004 Oister ..... A63B 49/00 473/570
2008/0064539 A1 * 3/2008 Mark ..... A63B 37/14 473/598
2009/0011870 A1 * 1/2009 Neal ..... A63B 43/00 473/451
2009/0069127 A1 * 3/2009 James ..... A63B 15/00 473/451
2013/0040766 A1 * 2/2013 Massey ..... A63B 69/0002 473/451
2014/0106907 A1 * 4/2014 Ebert ..... A63B 69/0002 473/451
2014/0135151 A1 5/2014 Johnston
2015/0018132 A1 1/2015 Lovelace et al.
2016/0136494 A1 5/2016 Johnston

* cited by examiner

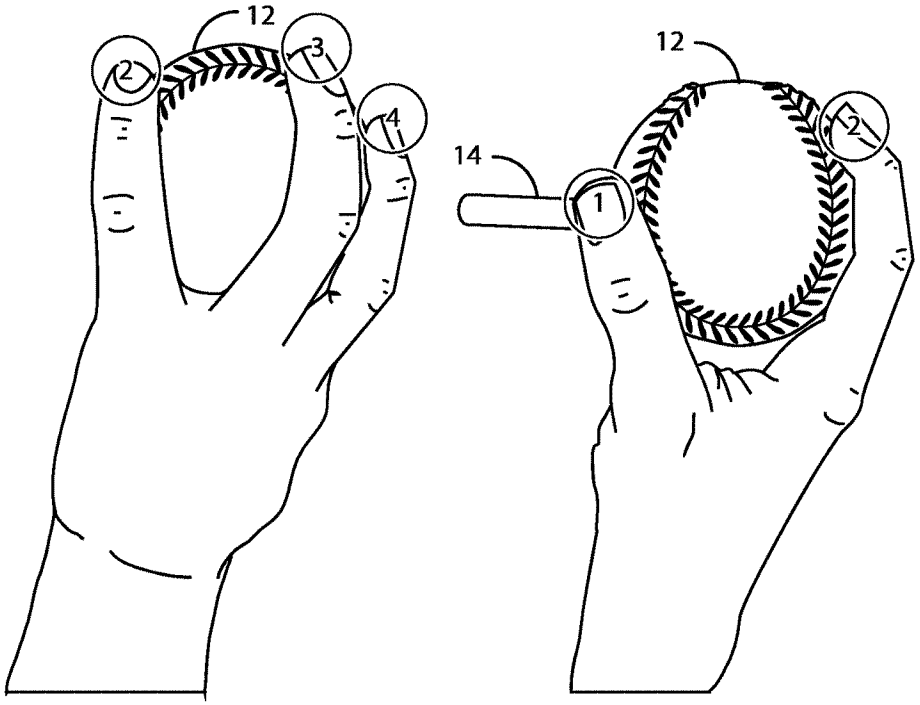
FIG. 16A
FIG. 16B
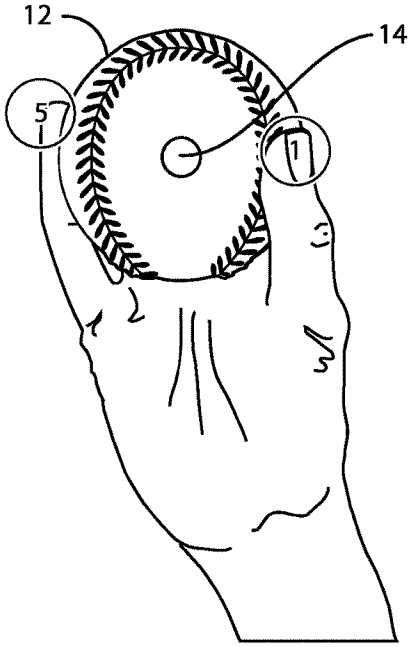
FIG. 16C

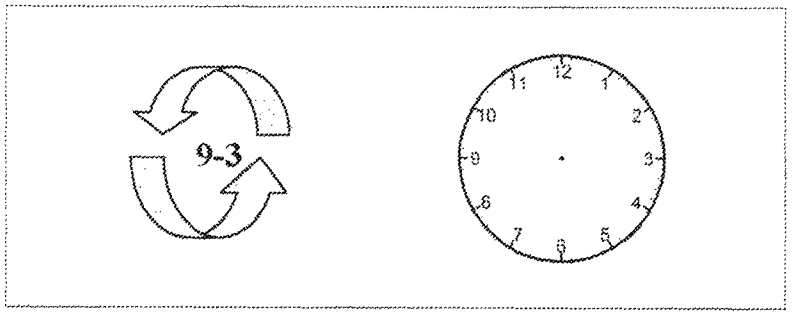
FIG. 20A
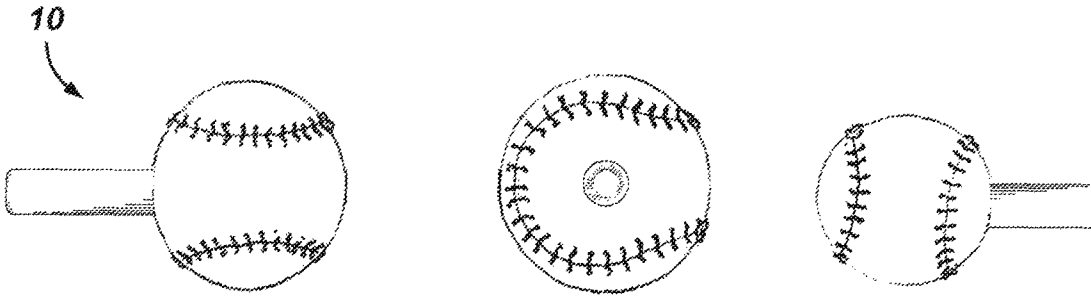
FIG. 20B
FIG. 20C
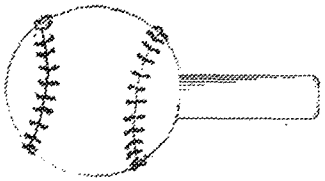
FIG. 20D
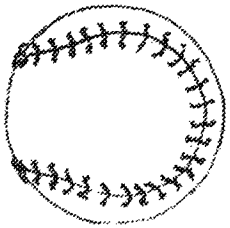
FIG. 20E

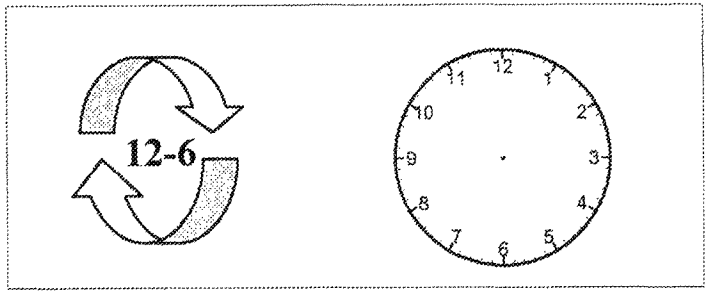
FIG. 24A
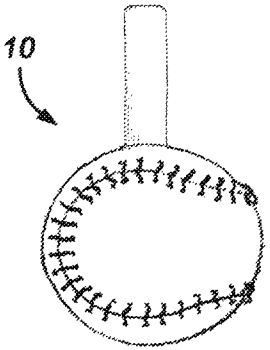
FIG. 24B
FIG. 24C
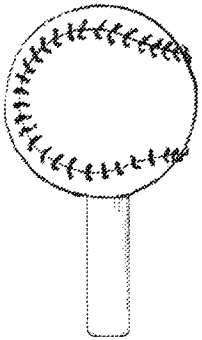
FIG. 24D
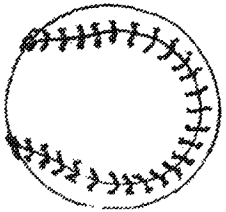
FIG. 24E

BALL ROTATION INDICATOR AND METHOD

CROSS-REFERENCE TO RELATED APPLICATIONS

This application is a continuation of application Ser. No. 14/960,240, filed Dec. 4, 2015, which is a continuation of application Ser. No. 14/178,172, filed Feb. 11, 2014, which is entitled to the benefit of the filing date of the prior-filed U.S. provisional application No. 61/763,191, filed on Feb. 11, 2013.

STATEMENT REGARDING FEDERALLY SPONSORED RESEARCH OR DEVELOPMENT

Not applicable.

FIELD OF THE APPLICATION

The application relates generally to devices, assemblies, systems, and methods in the field of sports ball rotation, training and analysis.

BACKGROUND

A vast number of sporting events include balls or spheres that are thrown, kicked or otherwise delivered toward a target person or object. In many cases the rotation of the ball affects the travel path of the ball. As such, it is often necessary in sports to control or dictate the rotation of a ball. Objects and methods for training persons how to affect ball rotation and for analyzing ball rotation is desired.

SUMMARY

The present application is directed to an athletic training tool including a ball and an elongated member attached thereto, the elongated member being attached to the ball in a manner effective to maintain the center of gravity of the ball.

The present application is also directed to a method of tracking the rotation of a sport sphere traveling in space comprising the following steps (1) providing a sport sphere with one or more elongated members extending from the surface of the sphere, the elongated member being attached to the ball in a manner effective to maintain the center of gravity of the sphere; (2) establishing a desired rotation for a sphere to be delivered; (3) while delivering the sport sphere analyzing the rotation of the sport sphere compared to the desired rotation.

The present application is also directed to a system for collecting real time rotational data of a delivered athletic ball comprising (1) an athletic training tool including a ball and an elongated member attached thereto, the elongated member being attached to the ball in a manner effective to maintain the center of gravity of the ball; (2) one or more sensors attached to the athletic training tool operationally configured to track movement of the athletic training tool; and (3) a computer in wireless communication with the one or more sensors for receiving movement data from the one or more sensors.

BRIEF DESCRIPTION OF THE FIGURES

FIG. 16A-16C illustrate an exemplary right-handed softball rise ball grip.

FIG. 20A-20E are illustrations related to the rotation of an exemplary softball curveball pitch.

FIG. 24A-24E are illustrations related to the rotation of an exemplary softball changeup pitch.

BRIEF DESCRIPTION

Figure 1:
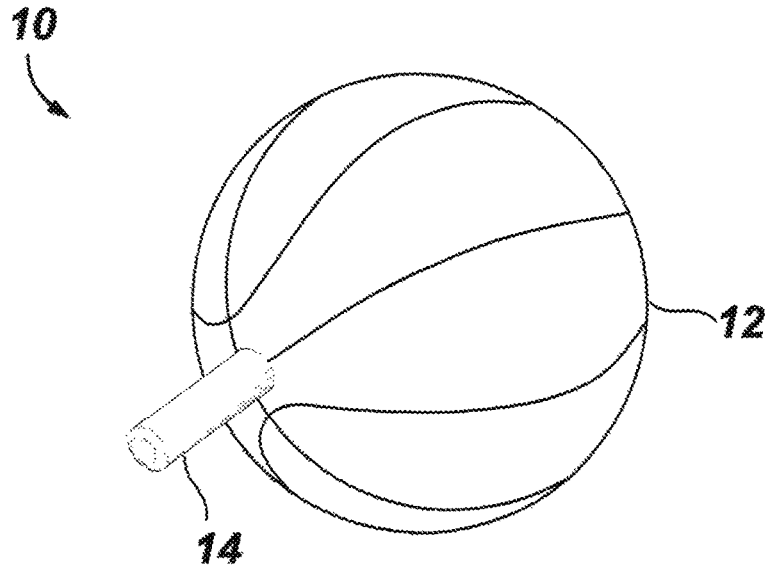
FIG. 1 is a simplified training tool of the present application including a basketball and indicator attached thereto.

It has been discovered that a ball or sphere can be equipped with one or more elongated members to assist individuals with observing the rotation pattern of the ball or sphere when in flight and/or rolling across a surface. The elongated members of this application may also assist a user on proper foot, hand and/or finger placement on a particular type of ball to achieve a particular rotation pattern of the ball. In addition, the elongated members herein do not hinder the use of the ball in their normal field of play. Heretofore, such a desirable achievement has not been considered possible, and accordingly, the invention of this application measures up to the dignity of patentability and therefore represents a patentable concept.

Before describing the invention in detail, it is to be understood that the present device, assembly, system and method are not limited to particular embodiments. It is also to be understood that the terminology used herein is for the purpose of describing particular embodiments only, and is not intended to be limiting. As used in this specification and the appended claims, the phrases "deliver," "project," "propel," "to project a ball," "to propel a ball" and like phrases or terms refer to an individual throwing, casting, hitting, kicking, or otherwise transporting a ball through space from his/her person or first location to a second location. A projected or propelled ball may be one traveling through air and/or a surface, e.g., a bouncing ball, or substantially rolling across a surface. The phrase "proper rotation" refers to Applicant's own philosophy regarding the correct aspects of proper ball rotation for a particular sport and ball. The phrase scale "muscle memory" refers to the process by which an individual's neuromuscular system memorizes motor skills, such as those motor skills related to Applicant's own philosophy regarding the way to produce proper ball rotation for a particular sport and ball. A "ball" used herein is not limited to any particular sphere but may include non-spherical objects too. The phrase "athletic ball" may refer to one or more round balls used in the various sports of the world, including but not necessarily limited to baseballs, softballs, basketballs, soccer balls, cricket balls, tennis balls, volleyballs, water polo balls, bowling balls, dodge balls, handballs, jai alai balls, lacrosse balls. "Athletic ball" may also refer to other non-round balls such as American footballs, rugby balls, and the like. A "regulation baseball" may include, for example, a baseball constructed according to the Official Rules of Major League Baseball (Rule 1.09). A "regulation softball" may include, for example, a softball constructed according to the Rules of the Amateur Softball Association of America (Rule 3, Section 3).

In one aspect, the application provides a training tool that provides instant feedback to an athlete, e.g., baseball/softball player, as to whether he or she has thrown a ball rotationally as desired. The training tool may also provide one or more indicia on the surface of the ball allowing a person to check the proper placement of his/her fingers on the ball prior to throwing the ball, e.g., one or more indicia may correspond to hand/finger placement according to one or more particular pitch grips in baseball and/or softball pitching.

In another aspect, the application provides a training tool and method for developing baseball pitchers and softball pitchers. The application further provides a training tool and method for analyzing pitches in flight.

In another aspect, the application provides a device and method for developing cricket bowlers.

In another aspect, the application provides an improved baseball and slow and fast pitch softball pitching training tool for use in reproducing the proper grips and rotation/spin of various pitches.

In another aspect, the application provides a training tool that may be videotaped or filmed during use and reviewed thereafter.

In another aspect, the application provides a ball having one or more indicators including one or more colors or color schemes effective to increase user observation of the ball when the ball is rotating in space.

In another aspect, the application provides a training tool effective to develop an individual's muscle memory to produce a repeatable athletic motion.

In another aspect, the application provides a training tool device or assembly effective to develop an individual's mechanics in one or more athletic related physical motions.

In another aspect, the application provides a training ball including a releasable elongated indicator member operationally configured to extend out from the surface of the corresponding ball in a manner effective to be visualized by one or more persons as the training ball is rotating during use.

In another aspect, the application provides a training ball including a releasable indicator member extending out from the surface of the corresponding ball, the indicator member being constructed from one or more resilient materials allowing the indicator member to bend or flex from an original extended position to a point of abutment with the surface of the ball and return to its original extended position thereafter.

In another aspect, the application provides a sport specific athletic training ball including a ball rotation indicator and/or one or more hand/finger indicators disposed along the surface of the ball.

In another aspect, the present application relates to a training tool that may be used during real time sports competition by one or more athletes without disrupting the athletes' natural relationship with the ball.

In another aspect, the present application provides a ball including an elongated member extending out there from, the ball and/or elongated member being operationally configured for remote sensing of movement data of the ball. The ball and/or elongated member may make use of one or more sensors including for example micro sensors, integrated circuits or related microchip technology for tracking movement, e.g., the rotation pattern, of the ball and/or the elongated member, recording data, storing data, analyzing date and/or otherwise using the data as desired. The technology may also be used to measure surface speed of a ball. Movement related data may be relayed to a computer having one or more desired software applications for use of the data. In one embodiment, the information may be relayed to a mobile application on a handheld electronic device such as a smartphone type computer or the like comprising an operating system. Such is effective to provide real-time data, analysis and direct feedback concerning movement of a delivered ball.

In another aspect, the present application provides a ball including an elongated member extending out there from, the elongated member including one or more light emitting diodes disposed along the surface of the elongated member as desired.

In another aspect, the present application provides a sports sphere including an elongated member extending from the surface of the sphere in a manner effective to showcase the rotation of the sphere in space while minimizing the forces acting on the sphere when traveling through space.

In another aspect, the present application provides a sports sphere including an indicator member extending from the surface of the sphere, the indicator including one or more whistle type members thereon effective to produce one or more sound frequencies as the sphere travels through space.

In another aspect, the present application provides a sports sphere including an indicator member extending from the surface of the sphere, the indicator including one or more sensors thereon effective to produce one or more sounds in reaction to the rotation of the sphere through space. For example, if a sphere is rotating through space as desired the sensor remains silent.

DISCUSSION

In sports, round athletic balls typically spin or rotate when being thrown, kicked, hit, rolled or otherwise projected a particular distance. A rotation is a circular movement of a ball around its center of rotation. Balls and spheres rotate around an imaginary line called a rotation axis. When an athletic ball such as a baseball travels through the atmosphere, the baseball experiences the force of gravity in addition to the drag and Magnus forces as understood by the skilled artisan. For example, when a baseball pitcher throws a baseball, the forward movement of the pitcher's arm propels the baseball with a force that produces a velocity. A countering force called drag (air resistance) slows the baseball down. Simultaneously, the force of gravity places a downward motion onto the baseball. When a ball spins, it creates an envelope of air around it called the boundary layer. This boundary layer moves with the ball whether it spins forward or backward or sideways. The interaction of this boundary layer with the surrounding air results in an outside force that changes the path of the baseball. As understood by persons of ordinary skill in the art, this is known as the "Magnus Effect."

The spin of the baseball dictates the rotation of the boundary layer. When the ball has back-spin, like a fastball, the boundary layer under the baseball shoots air forward into the air that is trying to move around the baseball. The opposing air flows result in slower air movement and higher air pressure underneath the baseball. On top of the ball, the boundary layer shoots air backward in the same direction as the air that is trying to move around the baseball. These air flows compliment each other and combine to create faster air movement and lower air pressure on top of the baseball. The combination of slower air movement under the ball and faster air movement over the ball creates lift that opposes gravity—a "rise." The Magnus Effect, in this case, acts just like an airplane wing. For a curveball, the top-spin is like turning that wing upside-down. The opposing air flows are now on top of the baseball and the complimentary air flows are on bottom. Here, the Magnus Effect creates lift that compliments gravity—a drop. With a tilted spin axis, the Magnus Effect creates a tilted lift. A left tilt adds right-to-left movement when the pitch has back-spin and left-to-right movement when the pitch has top-spin. A right tilt has the opposite effects. When a pitch spins perfectly sideways, like a screwball or a sweeping curveball, the Magnus Effect does not create a "rise" or drop. Instead, it creates sideways lift. Viewed from the top, clockwise spin results in left-to-right lift, and counter-clockwise spin results in right-to-left lift. The Magnus Effect is greatest when the baseball's rotation axis is perfectly perpendicular to the velocity of the baseball. As the rotation axis turns (or yaws) from perpendicular to parallel to the baseball's velocity, the Magnus effect decreases accordingly. Likewise, the magnitude of the Magnus effect increases as the spin axis moves from parallel to perpendicular to the baseball's velocity.

In sports, to achieve a desired path of travel of a ball in space it is often necessary to produce a particular ball rotation. Likewise, a particular ball rotation is often an indicator that a ball has been thrown, kicked, tossed, hit, etc., in a proper manner, otherwise a particular rotation would not have been achieved. For example, a properly shot basketball released from a person's hand should have a substantially true backspin, i.e., true north to true south of the ball, toward the basketball goal. By providing a training tool with an indicator member that is visible to the user and/or another person and/or a coach the rotation of a particular ball may be evaluated to determine its accuracy in regard to the optimum desired ball rotation for a particular activity in question.

To better understand the novelty of the device, assembly, system and method of use thereof, reference is hereafter made to the accompanying drawings. Generally, one simplified training tool of this application is provided in FIG. 1. As shown, the training tool 10 includes an athletic ball 12 (or "ball") and an elongated member or rotation indicator 14 (or "indicator") extending out from the surface of the ball 12. In one suitable embodiment, the longitudinal axis of the rotation indicator 14 is axially aligned with the central axis or rotation axis of the ball 12 (shown here as extending out from a basketball as such is understood by persons of ordinary skill in the field of athletics). In other embodiments, the rotation indicator 14 may extend out from a ball in a non-axially aligned orientation.

Figure 2:
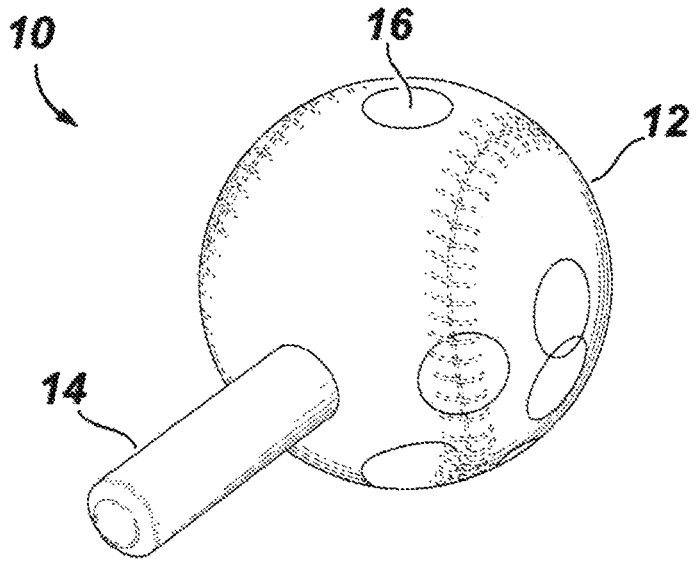
FIG. 2 is a simplified training tool of the present application including a baseball and indicator attached thereto.

With reference now to FIG. 2, another simplified training tool 10 is provided in the form of a baseball 12 and indicator 14 combination. The training tool 10 may also include one or more second indicators 16 (hand/finger indicia) disposed across the surface of the ball 12 as desired. As described below, hand/finger indicia 16 may be provided for a particular sport and/or to affect particular ball rotation (see also FIG. 3).

In one embodiment, the training tool 10 may be manufactured to include a ball 12 and indicator 14 in combination as desired. In another embodiment, the training tool 10 may be constructed using a preexisting ball 12 whereby an indicator 14 may be attached thereto. In one suitable embodiment of original manufacture, a training tool 10 may include an indicator 14 adhered directly to the outer surface of the ball 12. In another embodiment of original manufacture, the proximal end of an indicator 14 may be set below the surface of the ball 12 to a desired depth, e.g., a depth that substantially maintains the center of gravity of a particular ball 12 with the addition of a particular indicator 14.

Depending on the type of ball 12 in question, the ball 12 may be provided with a cavity or hole for receiving part of the indicator 14 in a mating position thereto. In one embodiment, the indicator 14 may be adhered to the inner surface of the cavity or hole using one or more adhesives. In another embodiment, an indicator 14 may be threadedly connected to the ball 12. In another embodiment, the indicator 14 may be attached to a ball 12 using a snap-fit type connection. In embodiments comprising threaded and snap-fit type connections, the indicator 14 may be removable as desired, e.g., in order to replace the indicator 14 or to provide a ball 12 less the indicator 14 for one or more purposes. Without limiting the invention, suitable adhesives include, but are not necessarily limited to thermosetting or thermoplastic adhesives, expanding glues, radiation cured adhesives, adhesives activated by solvents, and combinations thereof.

Figure 4:
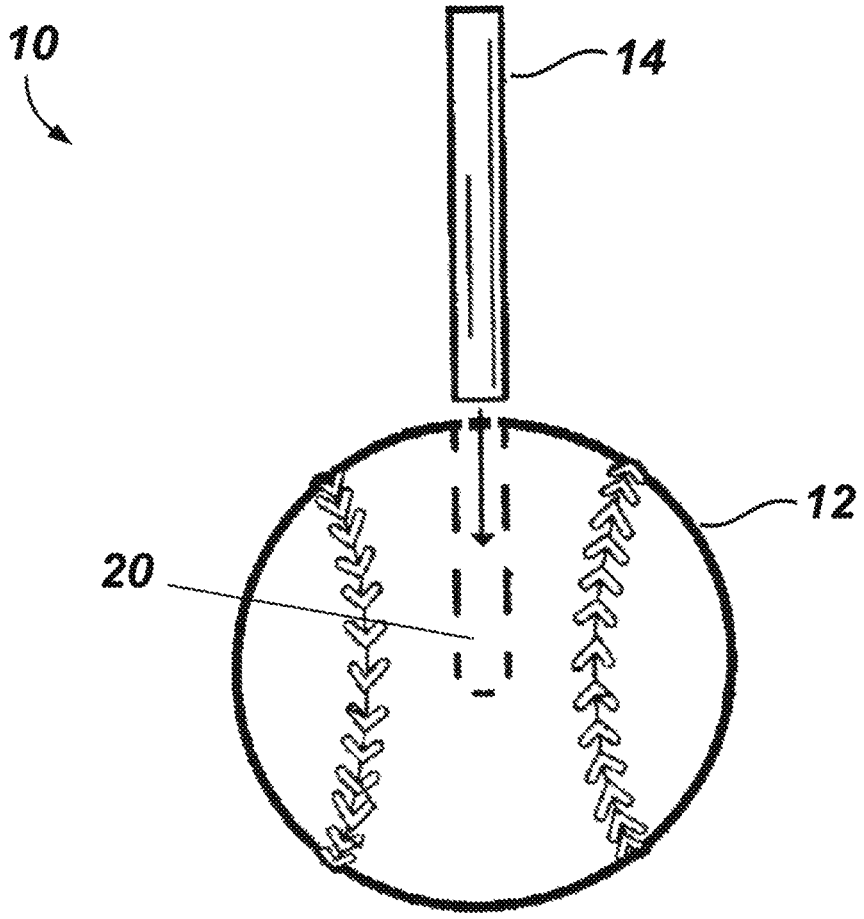
FIG. 4 is an exploded view of a simplified training tool of this application.

In other embodiments, a ball 12 for a particular sport may be acquired and there after converted into a training tool 10. For example, a regulation baseball 12 may be converted to a training tool 10 by adhering an indicator to the outer surface of the baseball 12. In another embodiment, an internal cavity or hole 20 may be formed into the baseball 12 for receiving at least part of an indicator 14 therein (see FIG. 4). In the embodiment of FIG. 4, a substantially linear hole 20 is formed into the baseball 12 to a desired depth to substantially maintain the center of gravity of the baseball 12 during training tool 10 use. Depending on the size and weight of the indicator 14, a hole 20 may be formed in a baseball 12 up to a depth of about 70.0 percent the outer diameter of the baseball 12 for receiving the indicator 14 therein. Thereafter, an indicator 14 may inserted into the hole 20 in a manner effective to maintain the indicator 14 within the baseball 12 when the baseball is being delivered through the air and/or across a surface. In one embodiment, the hole 20 includes a size and shape substantially similar to the indicator 14 for substantial abutment of the indicator 14 to the inner surface of the hole 20. In one simplified embodiment, the indicator 14 may include a cylindrical member whereby the inner surface of the hole 20 is formed to correspond to the outer shape of the indicator 14. In another embodiment, the indicator 14 may include a multi-sided member whereby the inner surface of the hole 20 is formed to correspond to the outer shape of the indicator 14. It is further contemplated that the hole 20 may include an inner surface not corresponding to the shape of the indicator 14 mated thereto. The above description may also apply to softballs and other balls comprising core filled materials.

Figure 5:
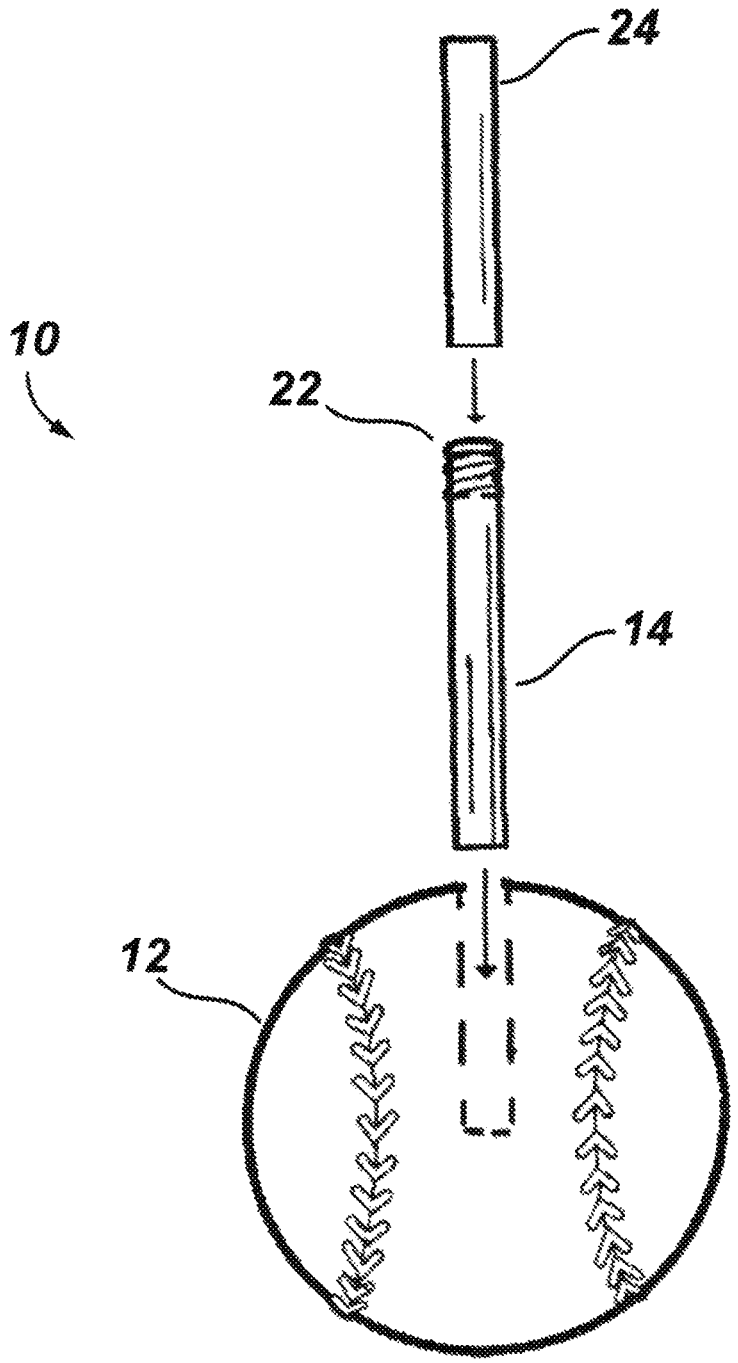
FIG. 5 is another exploded view of a simplified training tool of this application.
Figure 6:
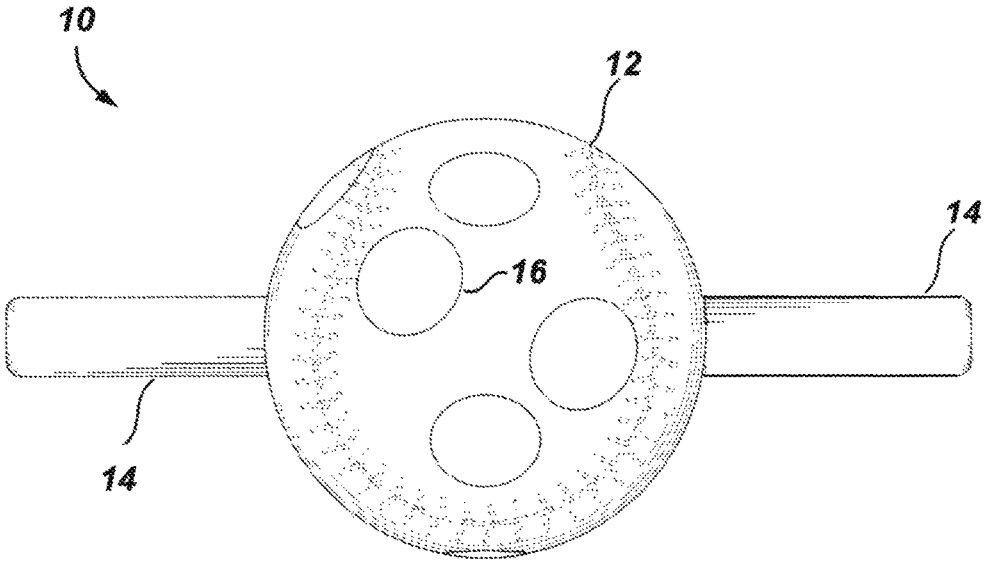
FIG. 6 is another simplified training tool of this application.

In another embodiment, the indicator 14 may be operationally configured to receive a secondary indicator in attachment thereto. As seen in the simplified embodiment of FIG. 5, the distal end 22 of the indicator 14 may be operationally configured to receive a secondary indicator 24 in connection thereto. In this simplified embodiment, the indicator 14 has a threaded connection for receiving a secondary indicator 24 in connection thereto. Other snap-fit type connections may be employed. In addition, secondary indicators 24 may also be operationally configured to receive additional indicators to provide an overall indicator of a particular length. In another embodiment, the training tool 10 may include two or more indicators 14 as shown in FIG. 6. In one embodiment, dual indicators 14 may be aligned as shown in FIG. 6. In another embodiment, dual indicators 14 may be disposed on a ball 12 in a non-linear orientation. In still another embodiment, two or more indicators 14 may be disposed on a ball 12 in a non-linear orientation. Referring to FIG. 6, one indicator member of a particular length may be disposed through the ball 12 to form dual indicators 14 as shown. In another embodiment, two separate indicator members may be attached to a ball to form dual indicators 12.

Without limiting the invention, a suitable indicator 14 has a length ranging from about the surface of the corresponding ball 12 out to a length greater than the outer diameter (or width) of the corresponding ball 12. Likewise, a suitable indicator 14 has a width (or outer diameter) up to about equal the outer diameter (or width) of the corresponding ball 12. In one particular embodiment, the length and width of the indicator 14, relative to the corresponding ball 12, is a size operationally effective to allow for use of the training tool 10 without disrupting the ball's 12 performance as accomplished with a stand alone ball 12. As an example, in an embodiment where the training tool 10 includes a baseball/softball 12 type device, a suitable indicator 14 has a size that does not affect a person's ability to catch the training tool 10 in a baseball/softball glove or mitt. In an embodiment where the training tool 10 includes a basketball 12 type device, a suitable indicator 14 has a size that allows for the training tool 10 to pass through a basketball goal (hoop and net). In addition, a suitable indicator 14 is attached to a ball 12 in a manner not affecting the center of gravity of the ball 12 thereby maintaining a true and correct spin in a substantially similar manner as a stand alone ball 12.

In an embodiment of a training tool 10 including a regulation baseball 12, a suitable indicator 14 has a visible length extending from the surface of the baseball 12 ranging from about 3.18 mm to about 50.8 mm (about 0.125 inches to about 2.0 inches) and a width ranging from about 3.18 mm to about 19.05 mm (about 0.125 inches to about 0.75 inches). In one suitable embodiment of a baseball type training tool 10, the visible length of the indicator 14 may be up to about 50.0 percent the outer diameter of the baseball 12, i.e., a ratio of about 1:2. In another suitable embodiment of a baseball type training tool 10, the width of the indicator 14 may be up to about 10.0 percent the outer diameter of the baseball 12, i.e., a ratio of about 1:10. As stated above, the length of the indicator 14 housed within a ball 12 may vary as necessary to substantially maintain the center of gravity of the ball 12. In terms of a regulation baseball 12, an indicator 14 may include a total length from about 6.35 mm to about 108.0 mm (about 0.25 inches to about 4.25 inches).

In an embodiment of a training tool 10 including a regulation softball 12, a suitable indicator 14 has a visible length extending from the surface of the softball 12 ranging from about 3.18 mm to about 57.15 mm (about 0.125 inches to about 2.25 inches) and a width ranging from about 3.18 mm to about 19.05 mm (about 0.125 inches to about 0.75 inches). In one suitable embodiment of a softball type training tool 10, the length of the indicator 14 may be up to about 40.0 percent the outer diameter of the softball 12, i.e., a ratio of about 2:5. In another suitable embodiment of a softball type training tool 10, the width of the indicator 14 may be up to about 6.5 percent the outer diameter of the softball 12, i.e., a ratio of about 3:50. In terms of a regulation softball 12, an indicator 14 may include a total length from about 6.35 mm to about 146.1 mm (about 0.25 inches to about 5.75 inches).

Figure 3:
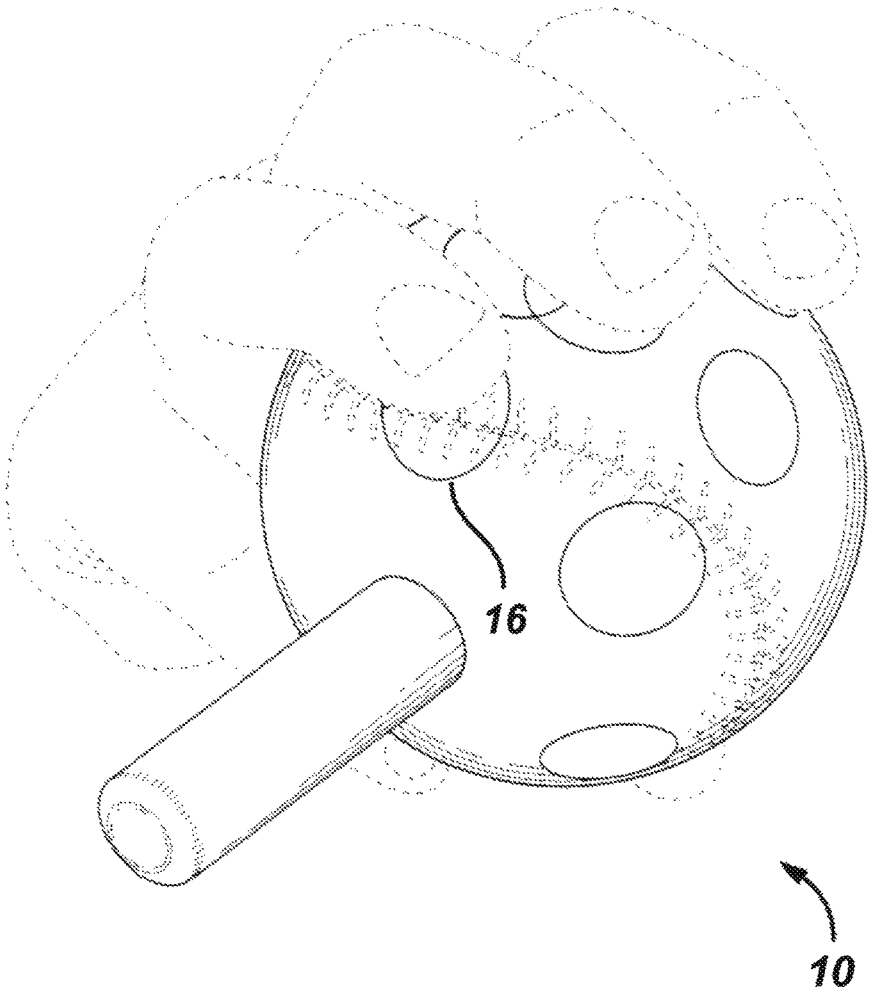
FIG. 3 is a simplified training tool being gripped by a person's hand.

Regardless the intended use of a particular training tool 10, a suitable indicator 14 is constructed from one or more resilient materials resistant to chipping, cracking and reshaping as a result of ozone, weathering, heat, moisture, other outside mechanical and chemical influences, as well as various impacts and other loads placed on the indicator 14. Suitable materials include resilient type materials (at least in part) operationally configured to be displaced from an original unstressed position ("P-1") to a stressed position ("P-2") and return to the unstressed position once an applied force is removed from the indicator 14 (see for example the simplified illustration in FIG. 7). Suitable materials may include, but are not necessarily limited to polymeric materials such as natural and synthetic rubbers, elastomers, plastics, and combinations thereof. Suitable rubbers may include, but are not necessarily limited to polymeric foam, polyurethane, latex, neoprene, and combinations thereof. Suitable polymeric foams may include, but are not necessarily limited to polyurethane foam, polyvinyl chloride ("PVC") foam, styrofoam, polyimide foam, silicone foam, and combinations thereof. Suitably plastics may include, but are not necessarily limited to nylon, vinyl polymers and PVC, polyethylene, polyethylene terephthalate ("PET"), polymethylpentene, polypropylene, polycarbonate, and combinations thereof. In operation, a suitable indicator 14 is operationally configured to remain in a static original and unstressed position until an external force is applied to the indicator 14—other than drag related forces placed upon the indicator 14 when traveling through space. One suitable indicator 14 original unstressed position includes a cylindrical indicator extending out substantially straight as shown in FIGS. 1-3.

Figure 7:
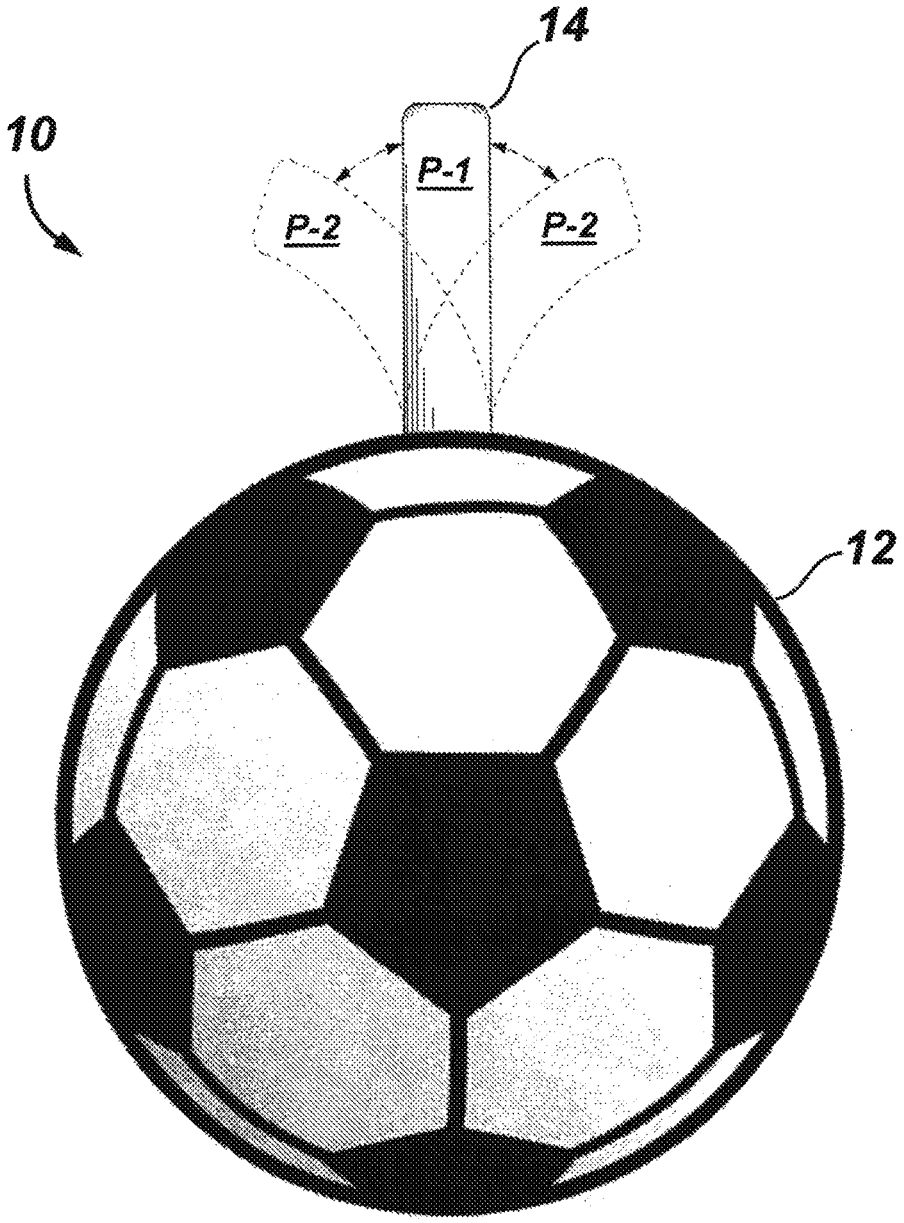
FIG. 7 is another simplified training tool of this application including a soccer ball and resilient indicator attached thereto.
Figure 8A:
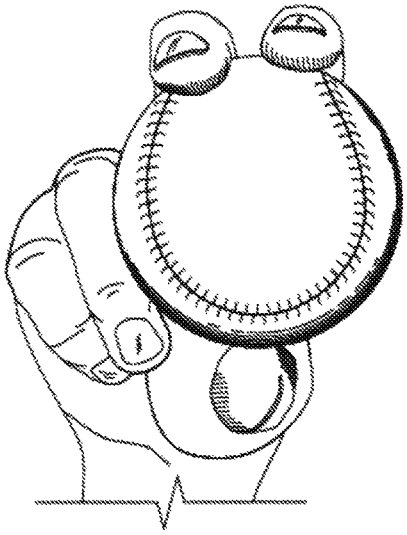
FIGS. 8A-8D are simplified illustrations of various baseball grips in a person's right hand.
Figure 8B:
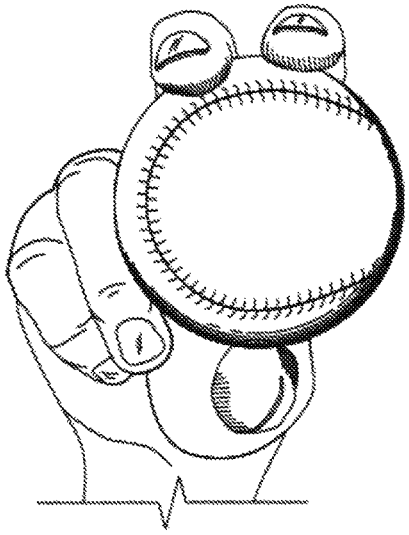
Figure 8C:
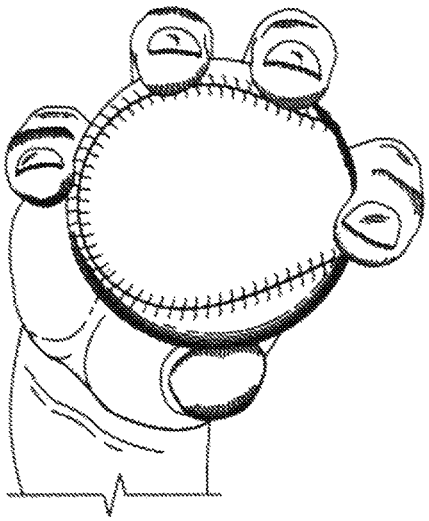
Figure 8D:
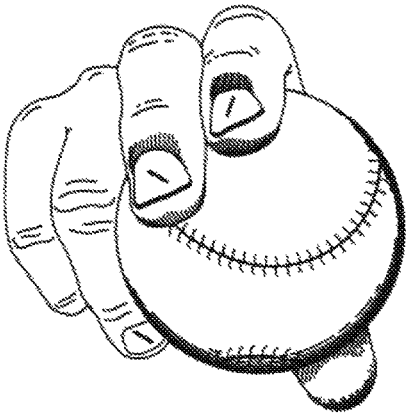

In one suitable embodiment, an indicator 14 may be constructed from a one-piece or solid resilient rubber or plastic material operationally configured to act as shown in FIG. 7 (positions P-1 and P-2). In one such embodiment, a suitable indicator 14 may be constructed from about Shore 40A to about Shore 80A polyurethane rubber (as hardness measurements are understood by the skilled artisan). In another embodiment, a suitable indicator 14 may be constructed from Shore 60A polyurethane rubber. In another embodiment, a suitable indicator 14 may be constructed from Shore 61A polyurethane rubber. In another embodiment, a suitable indicator 14 may be constructed from Shore 50A polyurethane rubber.

In another suitable embodiment, an indicator 14 may be constructed from two or more component parts as desired. For example, the indicator 14 may include a rubber member with a resilient member disposed longitudinally therein. Without limiting the invention, one suitable resilient member includes a resilient coil spring operationally configured to be manipulated, e.g., stretched and/or compressed, and return there after to its original unstressed position, e.g., position P-1. Although the training tool 10 may be built to scale, a suitable resilient member includes a length up to about 95.0 percent the length of the corresponding rubber member of the indicator 14. In an embodiment for use with baseball and softball, a suitable resilient member includes a length of about 6.35 mm (0.25 inches) less than the total length of the corresponding rubber member of the indicator 14. In operation, the proximal end of the resilient member is set about flush with the proximal end of the rubber member set inside the ball 12, i.e., the distal end of the resilient member is about 6.35 mm (0.25 inches) shorter than the distal end of the rubber member. Without limiting the invention to a particular embodiment or mode of operation, one suitable resilient member for use with a baseball or softball type indicator 14 may be provided as follows:

| | |
|---|---|
| Indicator Total Length: | about 88.9 mm (about 3.50 inches) |
| Resilient Member: | Steel Coil Spring |
| Length of Coil Spring: | about 82.6 mm (about 3.25 inches) |
| Outer Diameter of Coil Spring: | about 6.35 mm (about 0.250 inches) |
| Inner diameter of Coil Spring: | about 0.89 mm (about 0.035 inches) |
| Tension: | about 350.3 N/m (about 2.00 lbf/in) |
| Rate: | about 1.33 N/mm (about 7.600 lbs/in) |
| Suggested Maximum Load: | about 25.4 N (about 5.70 lbs) |

Without limiting the invention, a training tool 10 of this application may include a weight up to about 15.0 percent greater than a corresponding stand alone athletic ball 12. For example, a baseball related training tool 10 may weigh from about 5.0 to about 11.0 percent greater than a regulation baseball 12. A softball related training tool 10 may weigh from about 5.0 to about 16.0 percent greater than a regulation softball. In addition, an indicator 14 may include a weight from about 0.1 percent to about 20.0 percent the weight of a corresponding stand alone athletic ball 12.

It is further contemplated that an indicator 14 of this application may include one or more colors as desired. For example, the indicator 14 may include a bright color such as orange or red. In another embodiment, the indicator 14 may include a fluorescent color including, but not necessarily limited to fluorescent orange, yellow, and combinations thereof. The second indicators 16 may also include one or more colors as desired. For example, a baseball related training tool 10 as shown in FIG. 3 may include a plurality of indicators 16, each of the indicators 16 belonging to a particular color scheme wherein indicators 16 of a particular color are intended for a particular purpose, e.g., finger placement along a ball 12 as required to throw a particular type of pitch. For example, a baseball related training tool 10 may include twelve indicators 16 along its surface. Three of the indicators 16 may be a purple color, five indicators 16 may be green and four indicators 16 may be orange. Each of the color schemes may designate finger placement for a particular pitch, e.g., a fastball, a curveball, a slider, a changeup, etc., as these terms are understood by persons of ordinary skill in the art of baseball and softball.

OPERATION

Figure 9:
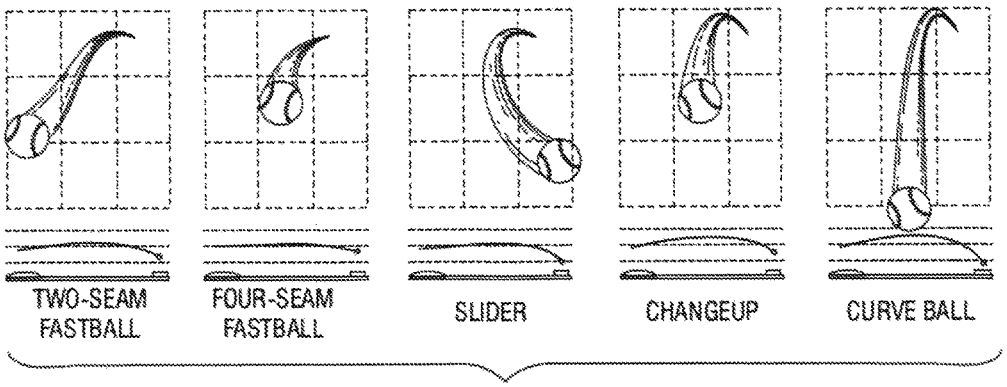
FIG. 9 illustrates the directional flight paths of various pitches as depicted from both a side view of the flight path of the pitched ball and from the catcher's view of the flight path of the pitched ball.
Figure 10:
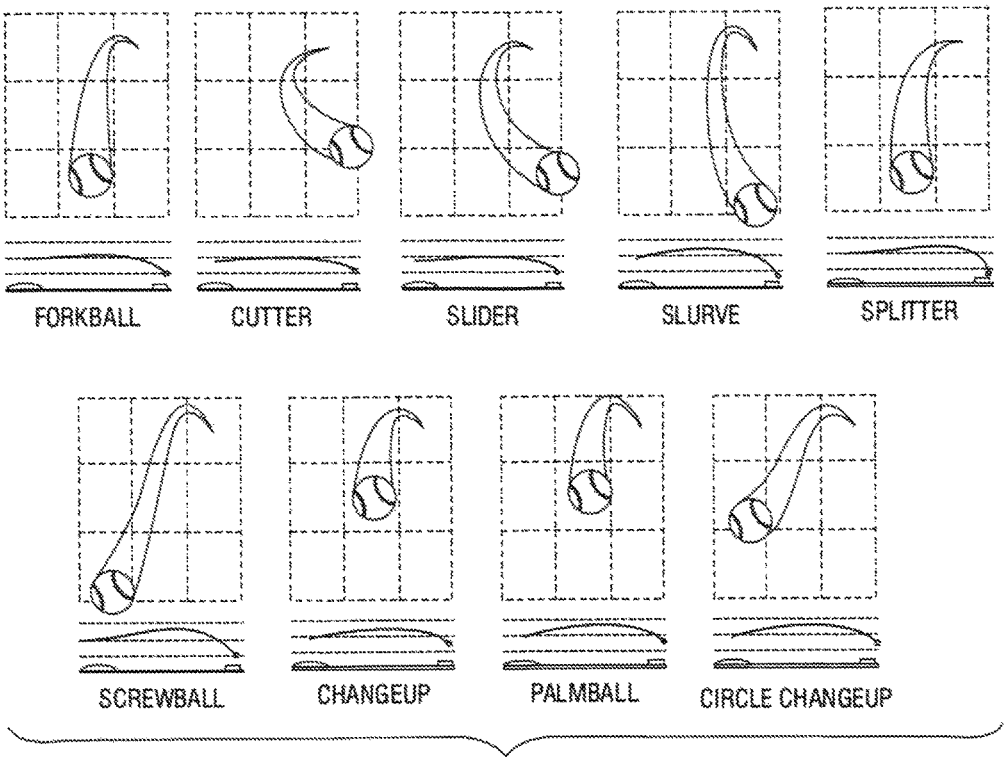
FIG. 10 illustrates the directional flight paths of various pitches as depicted from both a side view of the flight path of the pitched ball and from the catcher's view of the flight path of the pitched ball.

As stated above, to achieve a desired path of travel of a ball 12 in space it is often necessary to produce a particular ball rotation. Likewise, a particular ball rotation is often an indicator that a ball has been thrown, kicked, tossed, hit, etc., in a proper manner, otherwise a particular rotation would not have been achieved. In the sports of baseball and softball, pitchers typically cause a ball 12 to rotate in a particular manner (or not to rotate when throwing a knuckle ball as the term is understood by the skilled artisan) in an attempt to cause the ball 12 to travel along a particular path in space from the point of release of a ball 12 from the pitcher's throwing hand to a catcher set up behind home plate. As understood by persons of ordinary skill in the art of pitching, the manner in which a baseball or softball is gripped (see the simplified examples of FIGS. 8A-8D) in addition to the orientation and/or position of the arm and hand in space while performing the act of pitching affect the ball's rotation and thus it's flight path toward home plate (see the simplified flight paths of exemplary pitch types as illustrated in FIGS. 9 and 10). In terms of baseball/softball, the present training tool 10 is effective to provide real time feedback to (1) a person throwing the training tool 10, (2) a person catching the training tool 10 and (3) coaches and others observing as to the rotation of the training tool 10 as it travels through space according to the directional movement of the indicator 14 extending out from the ball 12. In addition, non-pitchers, who typically throw a ball 12 across the diamond or from the outfield with backspin, e.g., throwing a ball with four seams, may also benefit from the present training tool 10 in developing ideal backspin for making a particular type of throw, e.g., a catcher throwing a ball to second base during a stolen base attempt.

Turning now to a softball related training tool 10, exemplary grips and the rotation/spin of several pitches in slow and fast pitch softball will be discussed. Generally, the act of delivering a softball pitch includes a number of steps or phases, including (1) the preparation phase, (2) the cocking phase, (3) the arm acceleration phase and (4) the follow through phase. Pitching is a complex movement involving the lower body, the body core, upper body, and upper extremities through the various phases listed above. Like baseball, softball also includes a plurality of pitch types and travel paths, some of which are depicted in FIGS. 9 and 10. One popular pitch type in softball includes a fastball as the term is understood by the skilled artisan. The fastball is typically a pitcher's highest velocity and straightest flight path pitch type. Another popular softball pitch is the changeup, which may also be referred to as an "off-speed" pitch as the term is understood in the sports of baseball and softball. The changeup is thrown with a similar arm action as a fastball but the softball is held further back in the pitcher's hand resulting in less velocity on the pitch at release. Another off-speed pitch includes a "breaking ball" as understood in baseball and softball, which may include a ball traveling sideways or downward. As shown in FIGS. 9 and 10, some common breaking ball pitches in softball may include the curveball and slider. The grip and hand movement for a particular pitch is intended to cause a particular travel path in space of a pitched softball, e.g., a curveball pitch is intended to cause a forward spin of the ball 12 making the ball 12 travel in a downward motion (see FIG.

9). Other breaking ball pitches achievable in softball include, but are not necessarily limited to a peel drop pitch, rise ball (or riser), screw ball, and drop ball. In one particular embodiment, the training tool 10 may include one or more secondary indicators or indicia 16 to assist a user in the hand and/or finger placement on the ball 12 to achieve a particular type of pitch.

Figure 11C:
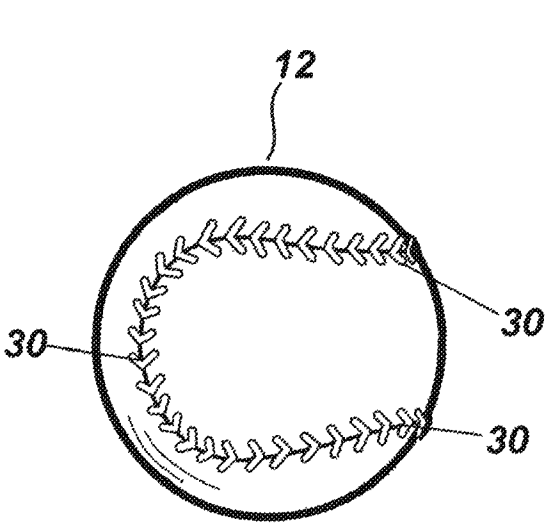
FIG. 11A-11C illustrate a softball related training tool.
Figure 11B:
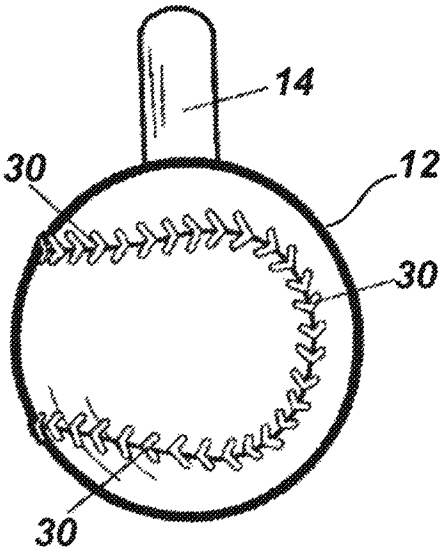
Figure 11A:
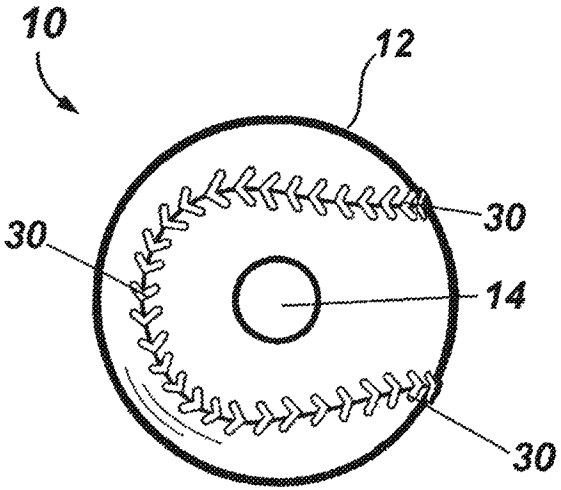

Turning to FIGS. 11A-11C, a softball related training tool 10 has a substantially circular body with the same size and dimensions as a regulation softball, although other sizes of softballs may be emulated. The ball 12 of the training tool 10 may be constructed from one or more materials including, but not necessarily limited to rubbers, plastics, leathers, synthetic leathers, polyurethane, and combinations thereof. Simulated or actual stitching ("seams" 30) of a regulation softball may be incorporated upon the ball 12 of the training tool 10 as desired. As understood by the skilled artisan, the configuration of the seams 30 of a regulation softball provide four parabolas. Each of the four horseshoe parabola is defined by an apogee with an upper parabolic curve and a lower parabolic curve. As the training tool 10 is rotated each of the four parabolic configuration changes as shown FIGS. 11A-11C. As shown, as the training tool 10 is rotated about 180.0 degrees, e.g., a half turn, the indicator 14 rotates from a position located on the near side of the ball 12 (FIG. 11A) to a position on the far side of the ball 12 (FIG. 11C).

Figure 12C:
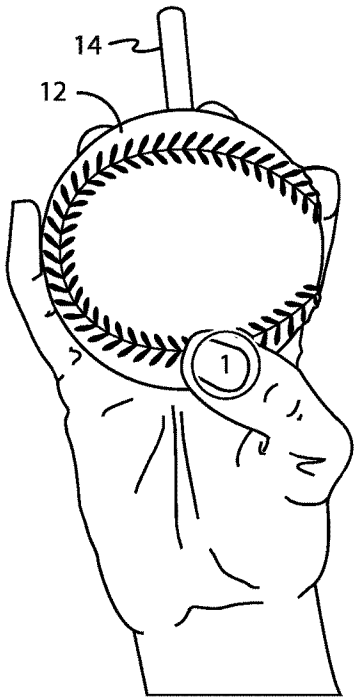
FIG. 12A-12C illustrate an exemplary right-handed softball fastball grip.
Figure 12B:
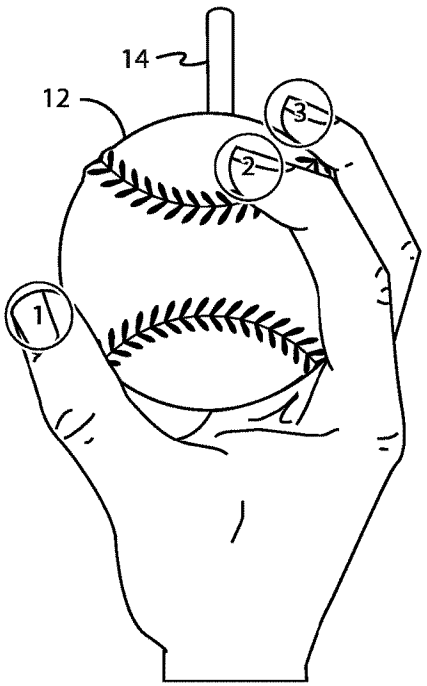
Figure 12A:
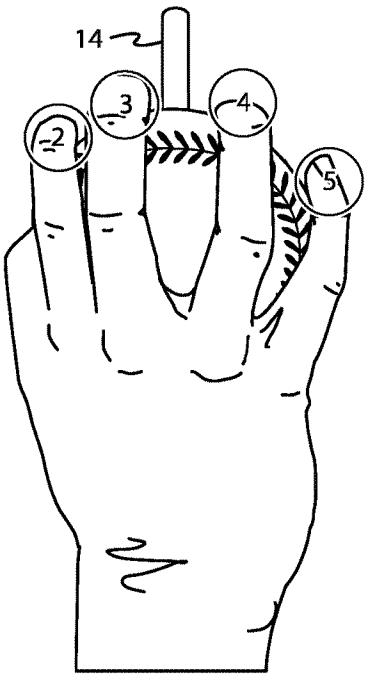
Figure 13A:
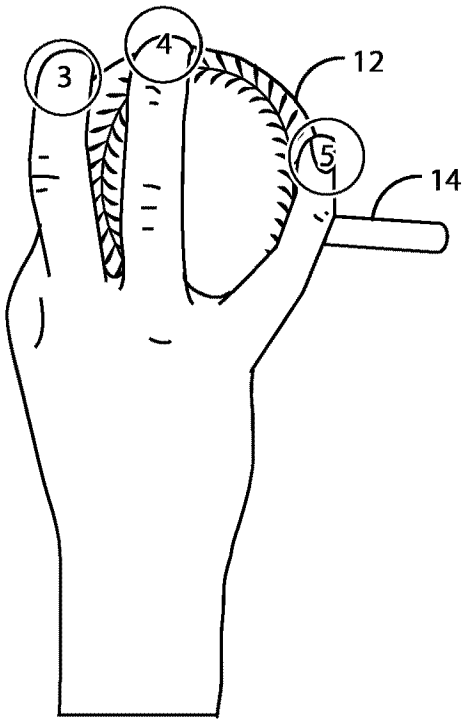
FIG. 13A-13C illustrate an exemplary right-handed softball curveball grip.
Figure 13B:
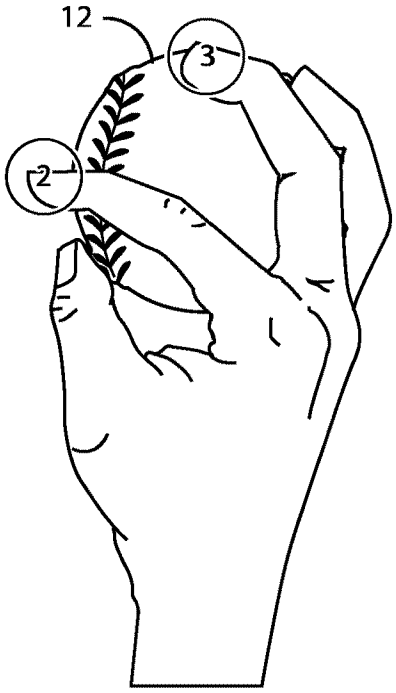
Figure 13C:
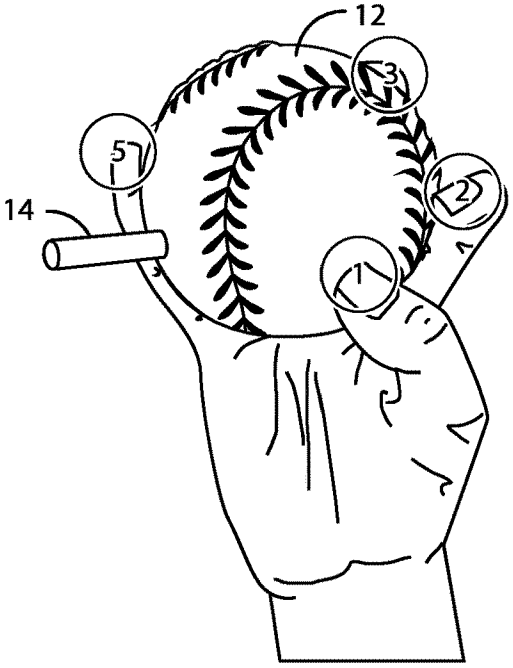
Figure 14C:
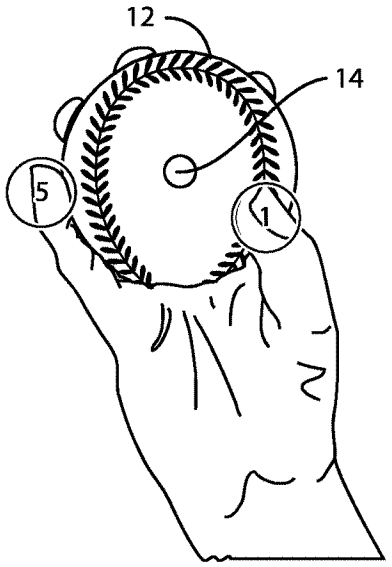
FIG. 14A-14C illustrate an exemplary right-handed softball drop ball grip.
Figure 14B:
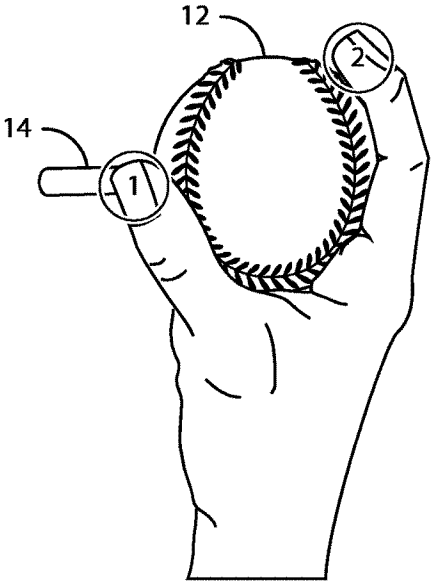
Figure 14A:
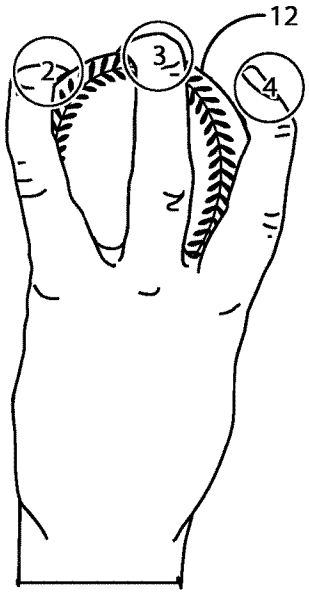
Figure 15C:
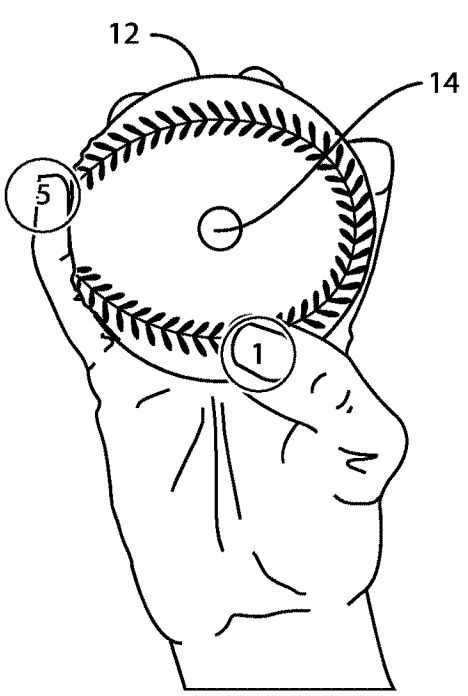
FIG. 15A-15C illustrate an exemplary right-handed softball peel drop grip.
Figure 15B:
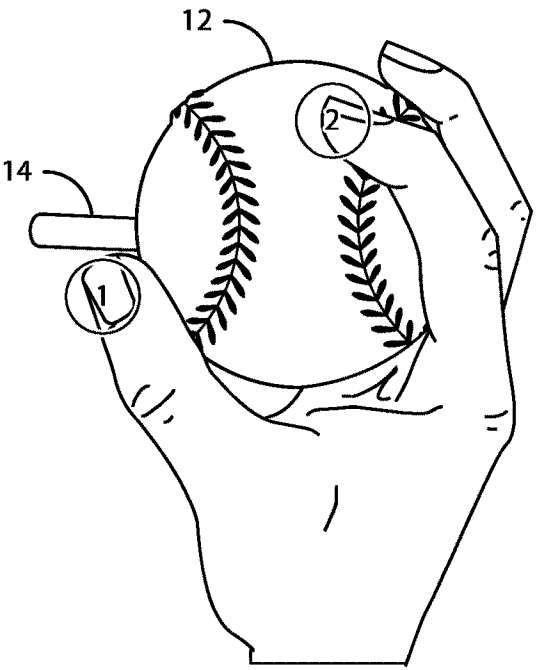
Figure 15A:
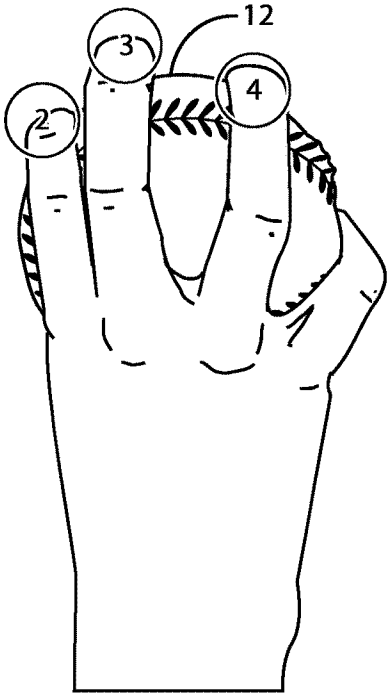
Figure 17C:
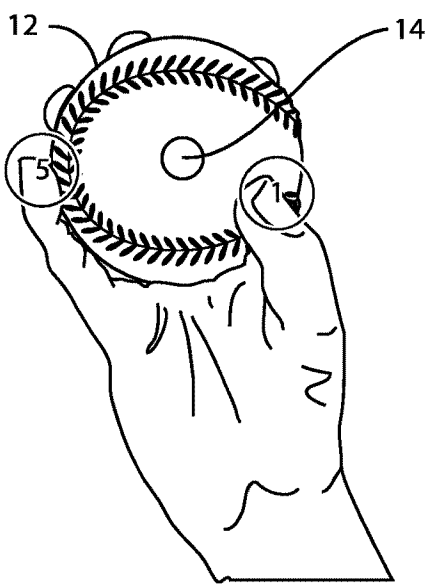
FIG. 17A-17C illustrate an exemplary right-handed softball changeup grip.
Figure 17B:
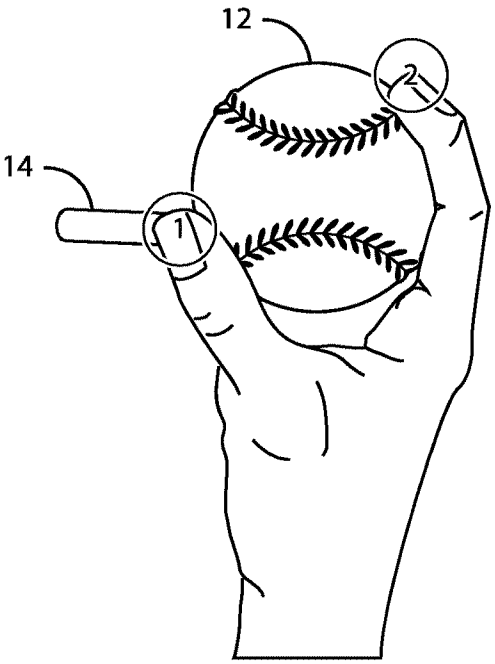
Figure 17A:
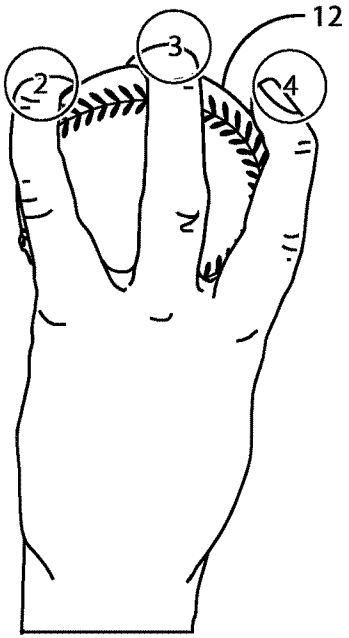
Figure 18C:
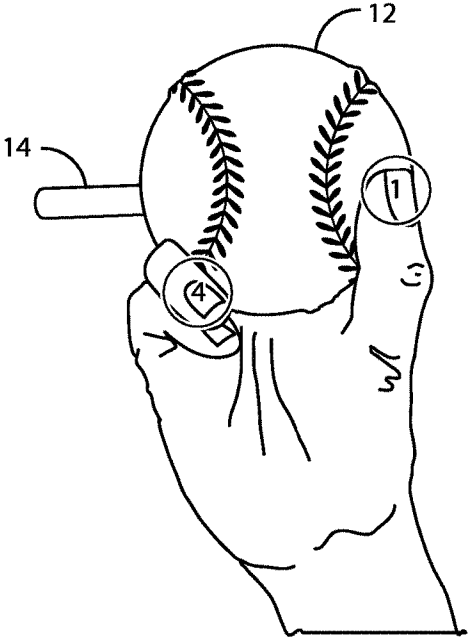
FIG. 18A-18C illustrate an exemplary right-handed softball screw ball grip.
Figure 18B:
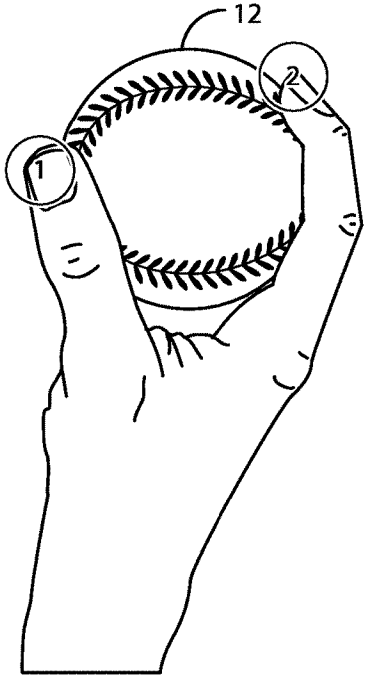
Figure 18A:
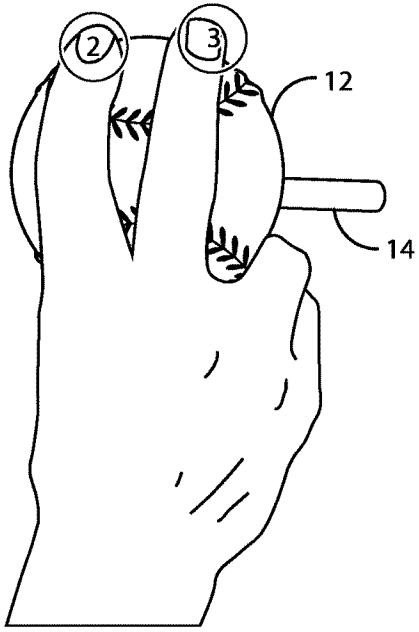
Figure 19A:
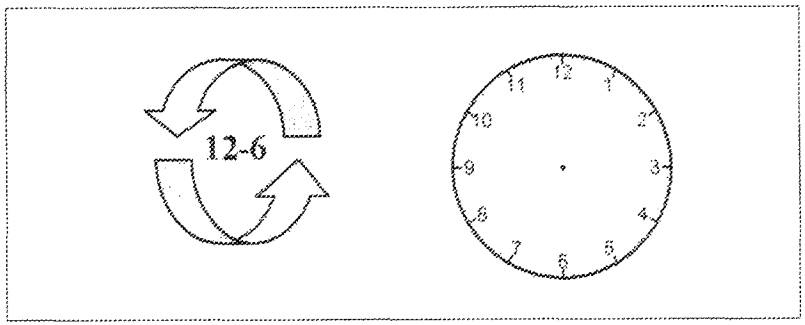
FIG. 19A-19E are illustrations related to the rotation of an exemplary softball fastball pitch.
Figure 19B:
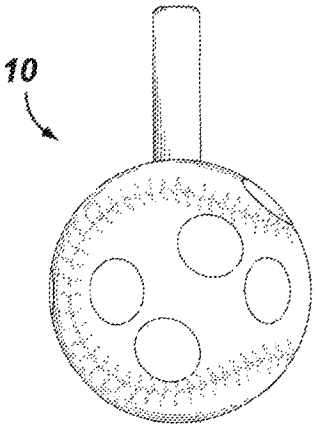
Figure 19C:
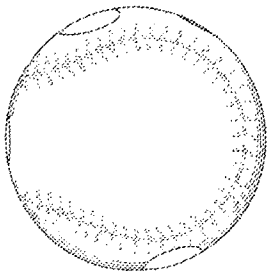
Figure 19D:
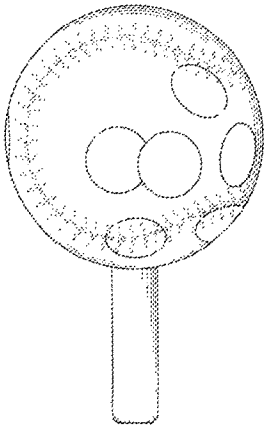
Figure 19E:
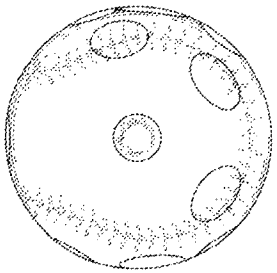
Figure 21A:
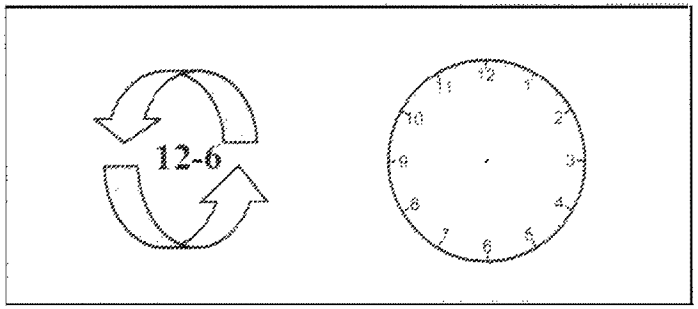
FIG. 21A-21E are illustrations related to the rotation of an exemplary softball drop ball pitch.
Figure 21B:
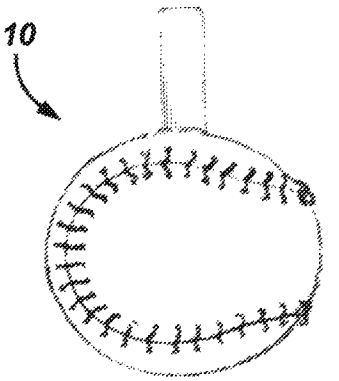
Figure 21C:
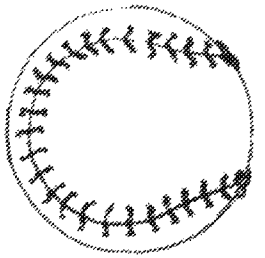
Figure 21D:
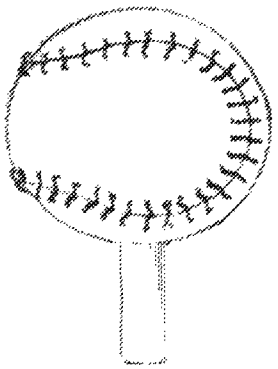
Figure 21E:
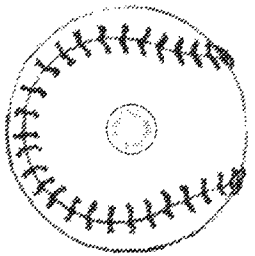
Figure 22A:
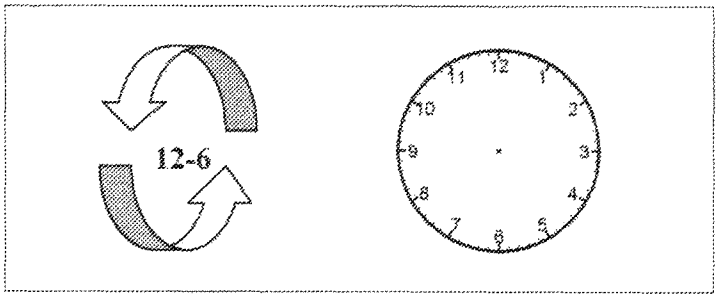
FIG. 22A-22E are illustrations related to the rotation of an exemplary softball peel drop pitch.
Figure 22B:
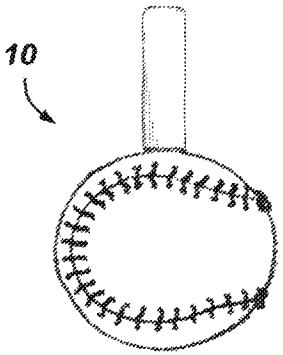
Figure 22C:
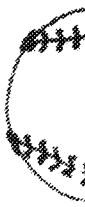
Figure 22D:
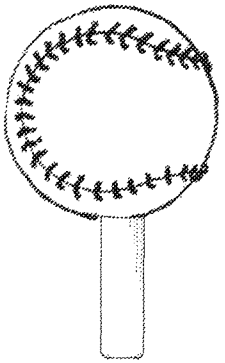
Figure 22E:
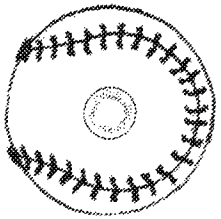
Figure 23A:
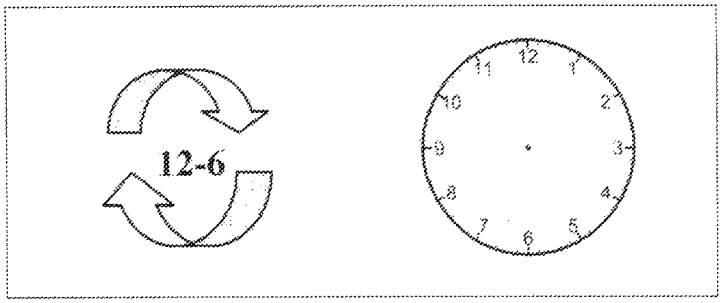
FIG. 23A-23E are illustrations related to the rotation of an exemplary softball rise ball pitch.
Figure 23B:
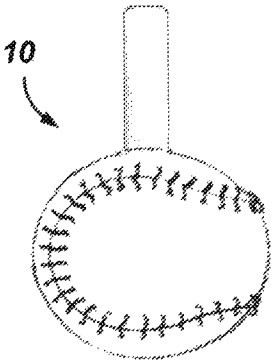
Figure 23C:
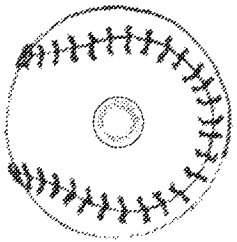
Figure 23D:
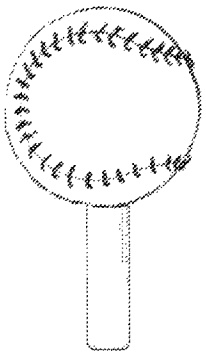
Figure 23E:
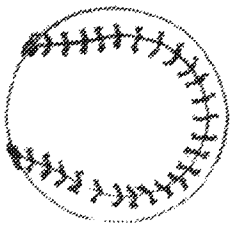
Figure 25A:
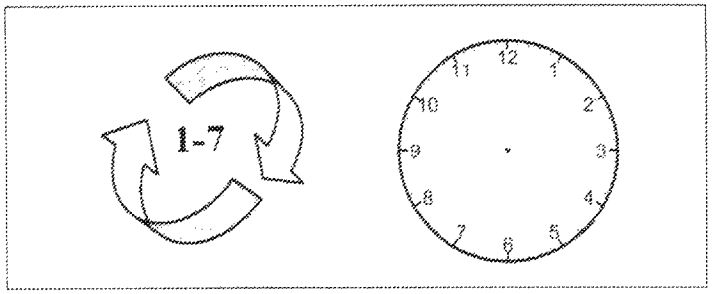
FIG. 25A-25E are illustrations related to the rotation of an exemplary softball screw ball pitch.
Figure 25B:
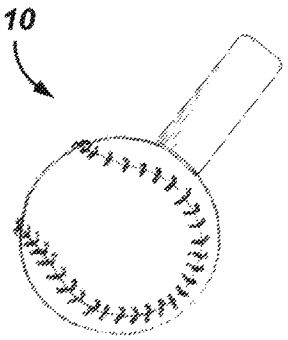
Figure 25C:
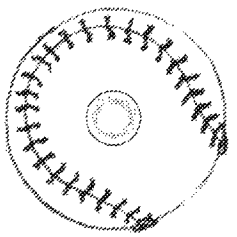
Figure 25D:
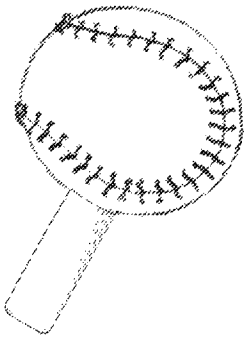
Figure 25E:
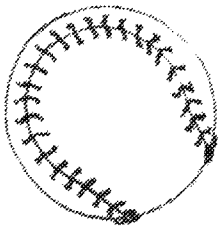

Various softball pitch types and the grip of each in relation to the training tool 10, indicia 16 thereon and position of the indicator are illustrated in FIGS. 12A-18C. For example, an exemplary fastball grip from different views (including fingertip locations #1-5) is shown in FIGS. 12A-12C. An exemplary curveball grip from different views (including fingertip locations #1-5) is shown in FIGS. 13A-13C. An exemplary drop ball grip from different views (including fingertip locations #1-5) is shown in FIGS. 14A-14C. An exemplary peel drop grip from different views (including fingertip locations #1-5) is shown in FIGS. 15A-15C. An exemplary rise ball grip from different views (including fingertip locations #1-5) is shown in FIGS. 16A-16C. An exemplary changeup grip from different views (including fingertip locations #1-5) is shown in FIGS. 17A-17C. An exemplary screw ball grip from different views (including fingertip locations #1-4) is shown in FIGS. 18A-18C.

Various softball pitch rotations in space are shown in relation to the training tool 10 in FIGS. 19A-25E. For example, four sides of a training tool 10 representing the rotation of a fastball pitch are depicted in sequential order with reference to FIGS. 19A-19E. Four sides of a training tool 10 representing the rotation of a right-handed curveball pitch are depicted in sequential order with reference to FIGS. 20A-20E. Four sides of a training tool 10 representing the rotation of a drop ball pitch are depicted in sequential order with reference to FIGS. 21A-21E. Four sides of a training tool 10 representing the rotation of a peel drop pitch are depicted in sequential order with reference to FIGS. 22A-22E. Four sides of a training tool 10 representing the rotation of a rise ball pitch are depicted in sequential order with reference to FIGS. 23A-23E. Four sides of a training tool 10 representing the rotation of a changeup pitch are depicted in sequential order with reference to FIGS. 24A-24E. Four sides of a training tool 10 representing the rotation of a screw ball pitch are depicted in sequential order with reference to FIGS. 25A-25E.

One advantage of the present training tool 10 includes that once a person has trained with the tool 10, the person may be subsequently given a regulation softball, whereby the person is likely to throw it according to the grip, rotation/spin and mechanics as utilized with the training tool 10. Thus, the training tool 10 may be employed for developing desired muscle memory for one or more throwing motions according to one or more rotational motions desired for a thrown softball 12.

The invention will be better understood with reference to the following non-limiting examples, which are illustrative only and not intended to limit the present invention to a particular embodiment.

EXAMPLE 1

In a first non-limiting example, a training tool 10 was provided by modifying a regulation baseball 12 to receive an indicator 14 in attachment thereto. The baseball 12 and indicator 14 had the following characteristics:

| | | |
|---|---|---|
| (1) Baseball 12 | Weight: | about 0.145 kg (about 5.10 ounces) |
| | Radius: | about 36.4 mm (about 1.43 inches) |
| (2) Indicator 14 | Materials: | Polyurethane Rubber |
| | Weight: | about 0.009 kg (about 0.3 ounces) |
| | Length: | about 88.9 mm (about 3.50 inches) |
| | Outer Diameter: | about 6.35 mm (about 0.25 inches) |

A hole 20 was formed in the baseball 12 to a depth of about 50.8 mm (about 2.0 inches) for receiving at least part of the indicator 14 therein. The weight of the baseball 12 was reduced to about 0.136 kg (about 4.80 ounces). The indicator 14 was mated with the hole 20 using an adhesive material. The total weight of the training tool 10 was about 0.153 kg (about 5.4 ounces).

EXAMPLE 2

In a second non-limiting example, a training tool 10 was provided by modifying a regulation baseball 12 to receive an indicator 14 in attachment thereto. The baseball 12 and indicator 14 had the following characteristics:

| | | |
|---|---|---|
| (1) Baseball 12 | Weight: | about 0.145 kg (about 5.10 ounces) |
| | Radius: | about 36.4 mm (about 1.43 inches) |
| (2) Indicator 14 | Materials: | Polyurethane Rubber<br>One Coil Spring |
| | Weight: | about 0.02 kg (about 0.6 ounces) |
| | Rubber: | about 0.009 kg (about 0.3 ounces) |
| | Spring: | about 0.009 kg (about 0.3 ounces) |
| | Length (Rubber): | about 88.9 mm (about 3.50 inches) |
| | Outer Diameter (Rubber): | about 6.35 mm (about 0.25 inches) |
| | Length (Spring): | about 82.6 mm (about 3.25 inches) |
| | Outer Diameter (Spring): | about 6.35 mm (about 0.250 inches) |

A hole 20 was formed in the baseball 12 to a depth of about 50.8 mm (about 2.0 inches) for receiving at least part of the indicator 14 therein. The weight of the baseball 12 was reduced to about 0.136 kg (about 4.80 ounces). The indicator 14 was mated with the hole 20 using an adhesive material. The total weight of the training tool 10 was about 0.162 kg (about 5.7 ounces).

EXAMPLE 3

In a third non-limiting example, a baseball related training tool 10 having the characteristics as described in Example 1 is provided. The training tool 10 includes a small motion sensor chip embedded within the indicator 14. The chip is in wireless communication with a computer. The chip is operationally configured to track rotational data for the training tool 10, which is relayed to computer software operationally configured to count, store and provide rotational data—from the moment the training tool 10 is released from a person's throwing hand to the moment the training tool 10 impacts a throwing target, e.g., a net or a catcher's mitt. Typically, the more rotations realized the greater the velocity of the thrown training tool 10. Thus, rotational counts are collected, stored and analyzed to evaluate changes in velocity for a particular individual according to one or more pitch types over a given period of time.

Persons of ordinary skill in the art will recognize that many modifications may be made to the present application without departing from the spirit and scope of the application. The embodiment(s) described herein are meant to be illustrative only and should not be taken as limiting the invention, which is defined in the claims.

I claim:

1. A method of tracking the rotation axis of a thrown athletic ball as the athletic ball travels through space, comprising:

providing an athletic ball with an outer surface having a first outer diameter and having one or more surface colors, the athletic ball consisting of a single rotation axis indicator defined by a first width, the single rotation axis indicator extending out from the surface of the athletic ball a first length which is at least half the distance of the first outer diameter in a fixed orientation relative to the surface of the athletic ball, the rotation axis indicator being defined by a longitudinal axis axially aligned with the rotation axis of the athletic ball, the rotation axis indicator including one or more colors different than the one or more surface colors of the athletic ball;

when gripping the athletic ball with a throwing hand (1) locating the rotation axis indicator apart from the palm of the throwing hand of a user in one of a plurality of locations according to a desired rotation of the athletic ball, a desired travel path of the athletic ball in space and a desired directional movement of the rotation axis indicator to be achieved when thrown and (2) placing the fingertips of the throwing hand about the surface of the athletic ball apart from the rotation axis indicator according to said desired rotation, travel path and directional movement in a manner effective to maintain a natural relationship between the athletic ball and the throwing hand, wherein the location of the fingertips in relation to the location of the rotation axis indicator is determined according to said desired rotation, travel path and directional movement; and once the athletic ball is thrown, observing the rotation axis indicator as the athletic ball travels through space along its travel path.

2. The method of claim 1 wherein one or more fingertip locations are apart from the surface of the athletic ball.

3. The method of claim 1 wherein the surface of the athletic ball includes one or more indicia providing indicators for fingertip placement for a plurality of possible athletic ball rotations, wherein the location of the one or more indicia are apart from the rotation axis indicator and correspond to the location of the rotation axis indicator according to said plurality of possible athletic ball rotations, the one or more indicia each having a maximum width at least as wide as said first width.

4. The method of claim 1 further including evaluating the observed rotation axis indicator to determine its accuracy in regard to the desired ball rotation.

5. The method of claim 3 wherein the location of the fingertips in relation to the location of the rotation axis indicator may be performed more than one way for a particular desired rotation of the athletic ball.

6. The method of claim 1 wherein the desired rotation equates to a desired pitch type.

7. The method of claim 1 wherein the location of the fingertips apart from the rotation axis indicator, user arm and hand position in space while performing the act of throwing dictate the travel path of a thrown athletic ball through space.

8. The method of claim 1 wherein the location of the fingertips apart from the rotation axis indicator, the location of the rotation axis indicator in relation to the palm of the throwing hand, user arm and hand position in space while performing the act of throwing dictate directional movement of the rotation axis indicator when the athletic ball is traveling through space.

9. The method of claim 1 wherein the athletic ball is thrown toward a target.

10. The method of claim 9 wherein the desired rotation of the athletic ball dictates the directional orientation of the rotation axis indicator in relation to the target at the point of release of the athletic as the athletic ball is being thrown.

11. The method of claim 3 wherein the one or more indicia provide a fingertip placement check about the surface of the athletic ball in relation to the location of the rotation axis indicator.

12. The method of claim 1 wherein the rotation axis indicator includes a fluorescent orange color.

13. A method of training a person to affect rotation of an athletic ball to be thrown through space toward a target, comprising:

providing an athletic ball having a first outer diameter defined by a rotation axis and having one or more surface colors other than fluorescent orange, the athletic ball consisting of a single visual indicator extending out from the surface of the athletic ball a first length which is at least half the distance of the first outer diameter in a fixed orientation relative to the surface of the athletic ball, the visual indicator being defined by a longitudinal axis axially aligned with the rotation axis of the athletic ball and having a fluorescent orange color;

determining a desired directional rotation of the athletic ball, a desired travel path of the athletic ball in space, a desired directional movement of the visual indicator in space when thrown and a desired location of the visual indicator in relation to a palm of a throwing hand at a moment of release of the athletic ball out from the throwing hand from among a plurality of locations;

having a person hold the athletic ball in the throwing hand by placing the fingers about the surface of the athletic ball and apart from the visual indicator according to the desired directional rotation of the athletic ball, the desired travel path of the athletic ball in space and the desired directional movement of the visual indicator in space in a manner effective to position the visual indicator in relation to the palm of the hand in the desired location at a moment of release of the athletic ball out from the throwing hand;

while the athletic ball is traveling through space toward the target once thrown, analyzing the rotation of the thrown athletic ball compared to the desired directional rotation by observing the directional movement of the fluorescent orange colored visual indicator.

14. The method of claim 13 including repeating said method and comparing the rotation of the athletic ball in space amongst a plurality of throws by observing the directional movement of the single visual indicator during each individual throw.

15. The method of claim 13 wherein the desired directional rotation corresponds to a desired flight path in space of the athletic ball from the point of release of the athletic ball to the target and to a particular directional movement of the visual indicator.

16. The method of claim 13 wherein the athletic ball is a regulation baseball.

17. The method of claim 6 wherein the desired directional movement of the rotation axis indicator in space is the same for more than one type of pitch.

18. The method of claim 13 wherein the desired location of the visual indicator in relation to the palm of the throwing hand at a moment of release of the athletic ball out from the throwing hand can be located in the same location for a plurality of travel paths of the athletic ball in space.

* * * * *